US011289267B2

(12) United States Patent
Idogawa

(10) Patent No.: US 11,289,267 B2
(45) Date of Patent: Mar. 29, 2022

(54) IGNITION COIL INCLUDING A CENTER IRON CORE AND SIDE IRON CORES

(71) Applicant: Mitsubishi Electric Corporation, Tokyo (JP)

(72) Inventor: Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/494,512

(22) PCT Filed: Mar. 30, 2017

(86) PCT No.: PCT/JP2017/013291
§ 371 (c)(1),
(2) Date: Sep. 16, 2019

(87) PCT Pub. No.: WO2018/179241
PCT Pub. Date: Oct. 4, 2018

(65) Prior Publication Data

US 2020/0013547 A1 Jan. 9, 2020

(51) Int. Cl.
*H01F 38/12* (2006.01)

(52) U.S. Cl.
CPC ..... *H01F 38/12* (2013.01); *H01F 2038/127* (2013.01)

(58) Field of Classification Search
CPC ..... H01F 38/12; H01F 2038/127; F02P 3/02
See application file for complete search history.

(56) References Cited

U.S. PATENT DOCUMENTS 3,968,465 A * 7/1976 Fukui ..... G01B 13/06 336/110
4,546,753 A * 10/1985 Pierret ..... H01F 3/14 123/634

(Continued)

FOREIGN PATENT DOCUMENTS

JP 03-116704 A 5/1991
JP 3042144 U 7/1997
WO 2016/181518 A1 11/2016

OTHER PUBLICATIONS

Internal Search Report for PCT/JP2017/013291 dated May 16, 2017 [PCT/ISA/210].

(Continued)

*Primary Examiner* — David Hamaoui
(74) *Attorney, Agent, or Firm* — Sughrue Mion, PLLC; Richard C. Turner

(57) ABSTRACT

Obtain an ignition coil in which a magnet is provided at a magnet holding portion which is formed between a first side iron core and a second side iron core, and intervening components which are configured by using a non-magnetic material, are included at facing portions which are provided at end portions of separated surfaces of the first side iron core and separated surfaces of the second side iron core, in a state where the magnet holding portion is formed by using the first side iron core and the second side iron core, and are faced at a surface which is vertical with respect to an axis direction of the side iron cores, and the intervening components have a thickness which is less than a distance between the separated surfaces of the first side iron core and the separated surfaces of the second side iron core.

16 Claims, 5 Drawing Sheets

(56) References Cited

U.S. PATENT DOCUMENTS 5,128,645 A * 7/1992 Suda ..... H01F 3/14 336/110
5,692,483 A * 12/1997 Wada ..... F02P 3/02 123/634
5,729,505 A * 3/1998 Murata ..... F02P 3/02 123/634
5,927,259 A * 7/1999 Ando ..... F02P 3/02 123/634
6,211,763 B1 * 4/2001 Morita ..... H01F 38/12 336/110
6,575,151 B2 * 6/2003 Murata ..... F02P 3/02 123/647
7,777,604 B2 * 8/2010 Matsubayashi ..... H01F 27/022 336/110
8,416,045 B2 * 4/2013 Henning, III ..... H01F 30/06 336/110
10,319,516 B2 * 6/2019 Sumitomo ..... H01F 1/053
10,438,740 B2 * 10/2019 Idogawa ..... H01F 38/12
2006/0226945 A1 * 10/2006 Maekawa ..... H01F 38/12 336/90
2008/0266040 A1 10/2008 Matsubayashi et al.
2009/0194084 A1 * 8/2009 Kojima ..... H01F 38/12 123/634
2014/0080077 A1 * 3/2014 Frontczak ..... H01T 13/44 431/258
2018/0025835 A1 * 1/2018 Idogawa ..... H01F 38/12 336/110
2018/0240589 A1 * 8/2018 Idogawa ..... H01F 38/12
2019/0214177 A1 * 7/2019 Idogawa ..... H01F 27/28

OTHER PUBLICATIONS

Japanese Office Action for Patent Application No. 2019-508025 dated Jul. 30, 2019.
Office Action dated Apr. 29, 2021 issued by the Chinese Patent Office in Chinese Application No. 201780088619.4 Translation.

* cited by examiner

IGNITION COIL INCLUDING A CENTER IRON CORE AND SIDE IRON CORES

CROSS REFERENCE TO RELATED APPLICATION

This application is a National Stage of International Application No. PCT/JP2017/013291 filed Mar. 30, 2017.

TECHNICAL FIELD

The present invention relates to an ignition coil which is attached, for example, to an internal combustion engine, and supplies a high voltage to an ignition plug so as to generate a spark electrical discharge.

BACKGROUND ART

In an ignition coil which is used for an internal combustion engine, for example, as indicated in Patent Document 1, a primary coil and a secondary coil are wound around an outer circumference of a center iron core, and a side iron core is arranged at an outer side (one side) of the primary coil and the secondary coil, whereby a closed magnetic passage is configured. These components are housed in an insulating case which is made of a resin, and moreover, an insulating material, such as an epoxy resin, is filled in space in the insulating case, whereby an insulation capability is maintained. Moreover, in order to increase an output capability, there is an ignition coil in which a large magnet is adopted and a large magnetic bias is applied to a center iron core. However, when a large magnet is inserted, an inserting portion (a holding portion) is upsized, so that in the ignition coil which is described in Patent Document 1, a magnet is inserted in a side iron core in a state where the magnet is inclined from an axis direction of the side iron core, whereby it is inhibited that the ignition coil is upsized.

CONVENTIONAL ART DOCUMENT

Patent Document

Patent Document 1: Japanese Utility Model Registration Publication No. 3042144

SUMMARY OF THE INVENTION

Problems to be Solved by the Invention

In recent years, in order to improve a fuel efficiency of an internal combustion engine, it is required that a high output capability is realized for an ignition coil, and moreover, it is also required that the ignition coil has a small size while various auxiliary machines are attached at a circumference of the ignition coil. In order to inhibit that an ignition coil is upsized, when a large magnet is inserted between side iron cores, there is a fear in which a position deviation of the side iron cores is caused (a magnet inserting portion is rotated) when the side iron cores are assembled to a center iron core, and a capability variation (a capability worsening) is caused.

The present invention has been made to solve the above-described problems, and an object of the invention is to obtain an ignition coil in which an assembly variation (a capability variation or a capability worsening, which is caused by an assembly variation) is not caused even when a large magnet is inclined so as to be arranged between the side iron cores.

Means for Solving Problems

An ignition coil of the present invention includes a center iron core around which a primary coil and a secondary coil, which is coaxially provided at a circumference of the primary coil, are wound; and side iron cores which surround a part of a circumference of the secondary coil so as to be arranged, and form a closed magnetic passage with the center iron core; in a state where the side iron cores are composed of a first side iron core and a second side iron core, in which portions, which are faced to a portion in an axis direction of the center iron core in a state where the primary coil and the secondary coil are sandwiched, are separated in an oblique direction with respect to an axis direction of the side iron cores, and a magnet is provided at a magnet holding portion which is formed between the first side iron core and the second side iron core, which are separated; wherein facing portions, which are provided at end portions of separated surfaces of the first side iron core and at end portions of separated surfaces of the second side iron core, in a state where the magnet holding portion is formed by using the first side iron core and the second side iron core, and are faced at a surface which is vertical with respect to an axis direction of the side iron cores, and intervening components, which are provided at the facing portions and are configured by using a non-magnetic material, are included; and the intervening components have a thickness which is less than a distance between the separated surfaces of the first side iron core and the separated surfaces of the second side iron core.

Effects of the Invention

According to an ignition coil of the present invention, surfaces, which are vertical in an axis direction, are provided at separated portions of side iron cores, whereby a rotational position deviation of the side iron cores, which is caused when the ignition coil is assembled, can be inhibited. Moreover, intervening components, which are configured by using a non-magnetic material, are provided at vertical portions of the side iron cores, whereby it can be also prevented that when the ignition coil is assembled, the side iron cores are adsorbed to each other by a magnetic force which is caused by a magnet which is arranged at a magnet holding portion which is formed at the separated portions of the side iron cores, and an assembly variation (a variation of a length of a gap) of the side iron cores can be inhibited.

MODE FOR CARRYING OUT THE INVENTION

Hereinafter, embodiments of an ignition coil of the present invention will be explained in reference to the drawings.

Embodiment 1

Figure 1:
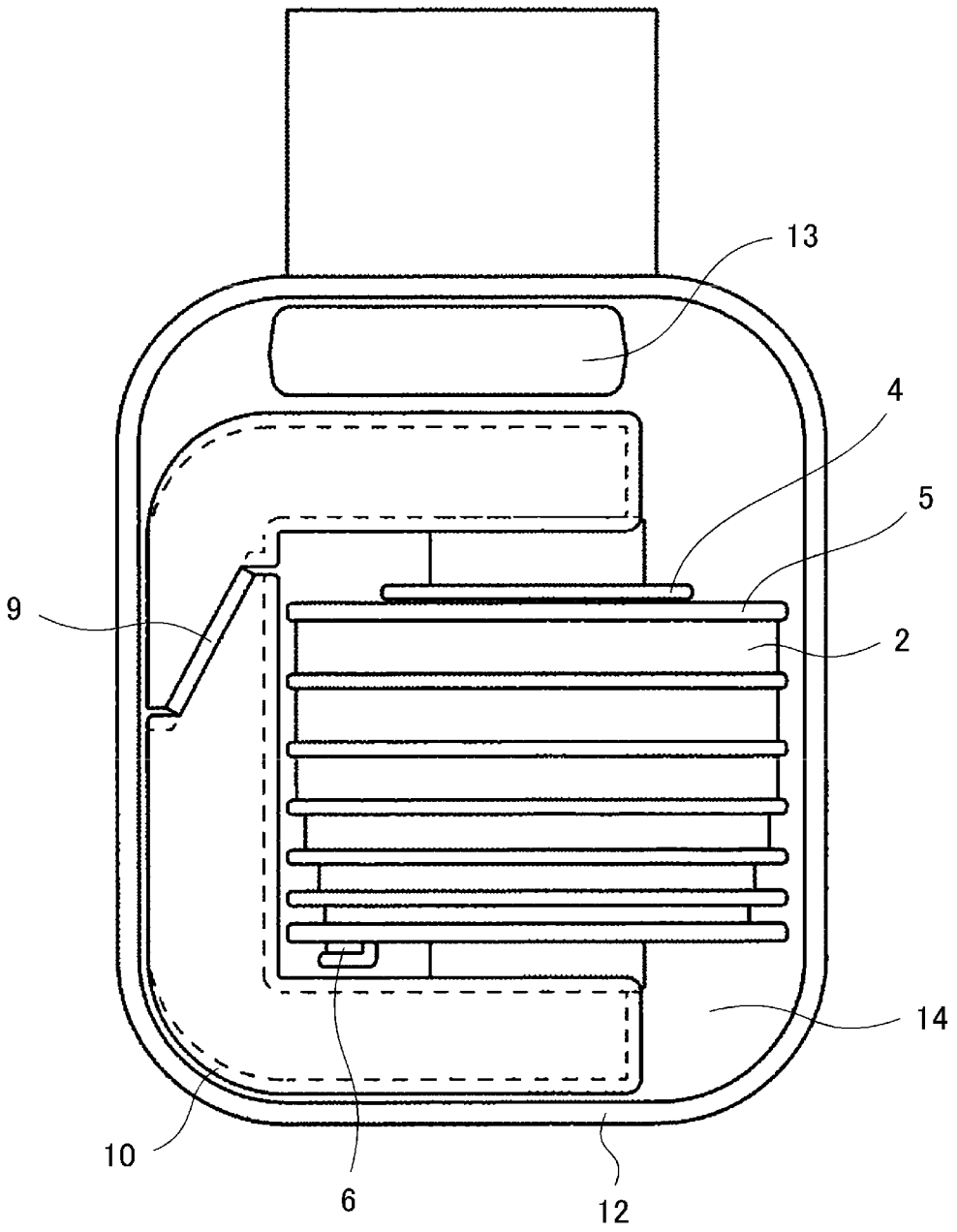
FIG. 1 is a view which indicates an ignition coil according to Embodiment 1 of the present invention.

FIG. 1 is a configuration view which indicates an ignition coil according to Embodiment 1 of the present invention.

Figure 2:
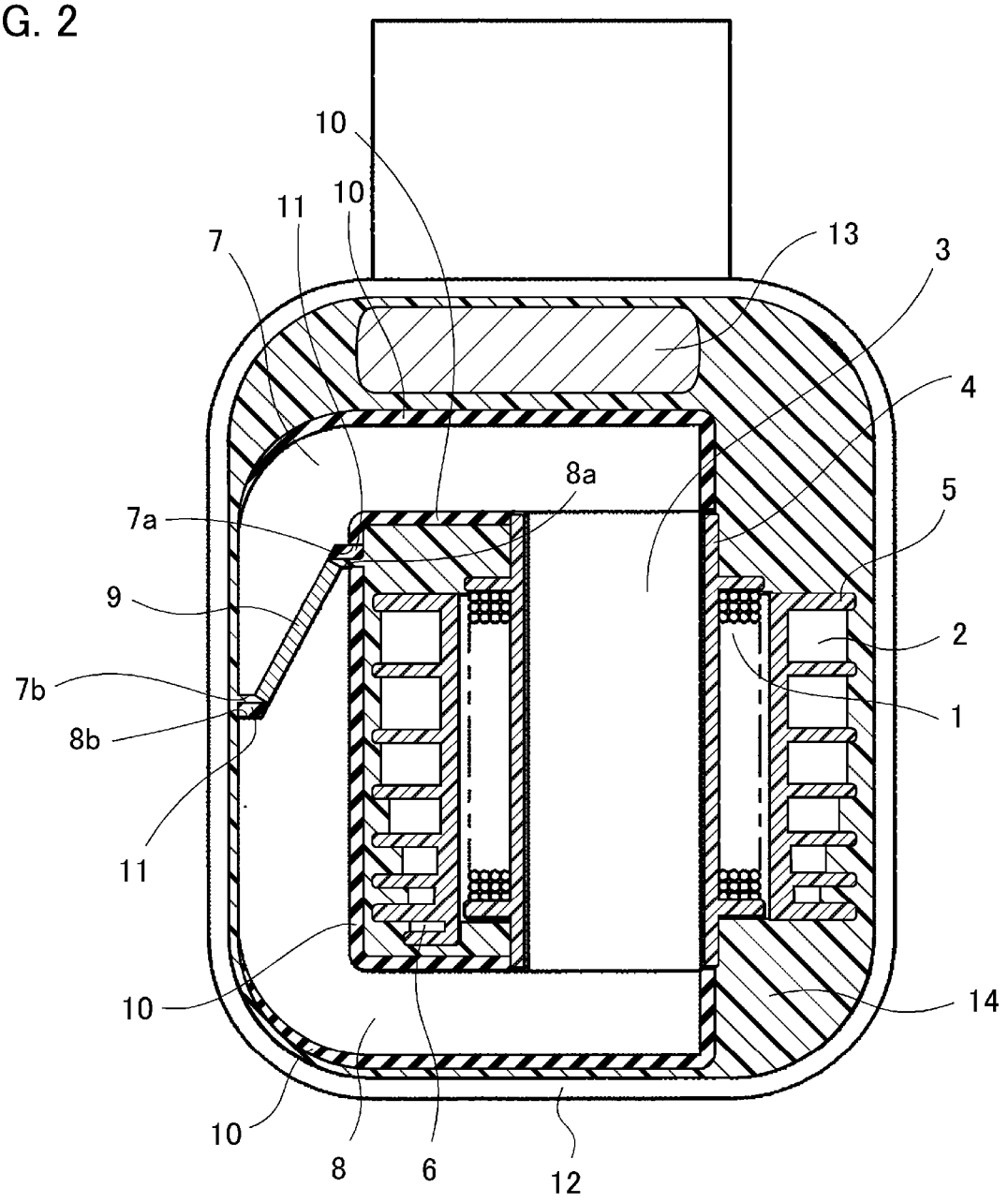
FIG. 2 is a cross-sectional view of the ignition coil which is indicated in FIG. 1.

Moreover, FIG. 2 is a cross-sectional view of the ignition coil which is indicated in FIG. 1.

As indicated in FIG. 1 and FIG. 2, in the ignition coil according to Embodiment 1, a primary coil 1 and a secondary coil 2 are coaxially arranged at a center iron core 3, and side iron cores, which are composed of a first side iron core 7 and a second side iron core 8 in a state where the first side iron core 7 and a second side iron core 8 are faced to the center iron core 3 so as to be separated, are arranged. In other words, the side iron cores are composed of the first side iron core 7 and the second side iron core 8, in which portions, which are faced to a portion in an axis direction of the center iron core 3 in a state where the primary coil 1 and the secondary coil 2 are sandwiched, are separated in an oblique direction with respect to an axis direction of the side iron cores. Moreover, a closed magnetic passage is formed by using the center iron core 3, the first side iron core 7, and the second side iron core 8. The primary coil 1 is wound around a primary bobbin 4, and the secondary coil 2 is wound around a secondary bobbin 5. Each of the first side iron core 7 and the second side iron core 8 is covered by using elastomers 10 in order to perform shock absorption of a thermal stress. Moreover, a magnet 9 is inclined so as to be inserted to a magnet holding portion which is formed between the side iron cores of the first side iron core 7 and the second side iron core 8, which are separated, and these components are housed in a case 12. Moreover, an integrated circuit (IC) 13, which is used for controlling, is arranged between a side surface of an inner wall of the case 12 and the first side iron core 7. In the case 12, an insulating resin 14, which is an epoxy resin which has a heat hardening characteristic, is filled so as to be hardened.

In the ignition coil which is configured as described above, the integrated circuit (IC) 13 controls an energization operation and an interruption operation of a primary electric current, which is passed through the primary coil 1, in accordance with a driving signal which is transmitted from an electronic control unit which is not illustrated. When a primary electric current, which is passed through the primary coil 1 at a predefined ignition timing of an internal combustion engine, is interrupted in accordance with the driving signal, a reverse electromotive force is generated at the primary coil 1, and a high voltage is generated at the secondary coil 2. Moreover, the high voltage, which is generated, is applied to an ignition plug, which is not illustrated, via a high-voltage terminal 6 which is arranged at a high voltage side.

Figure 3:
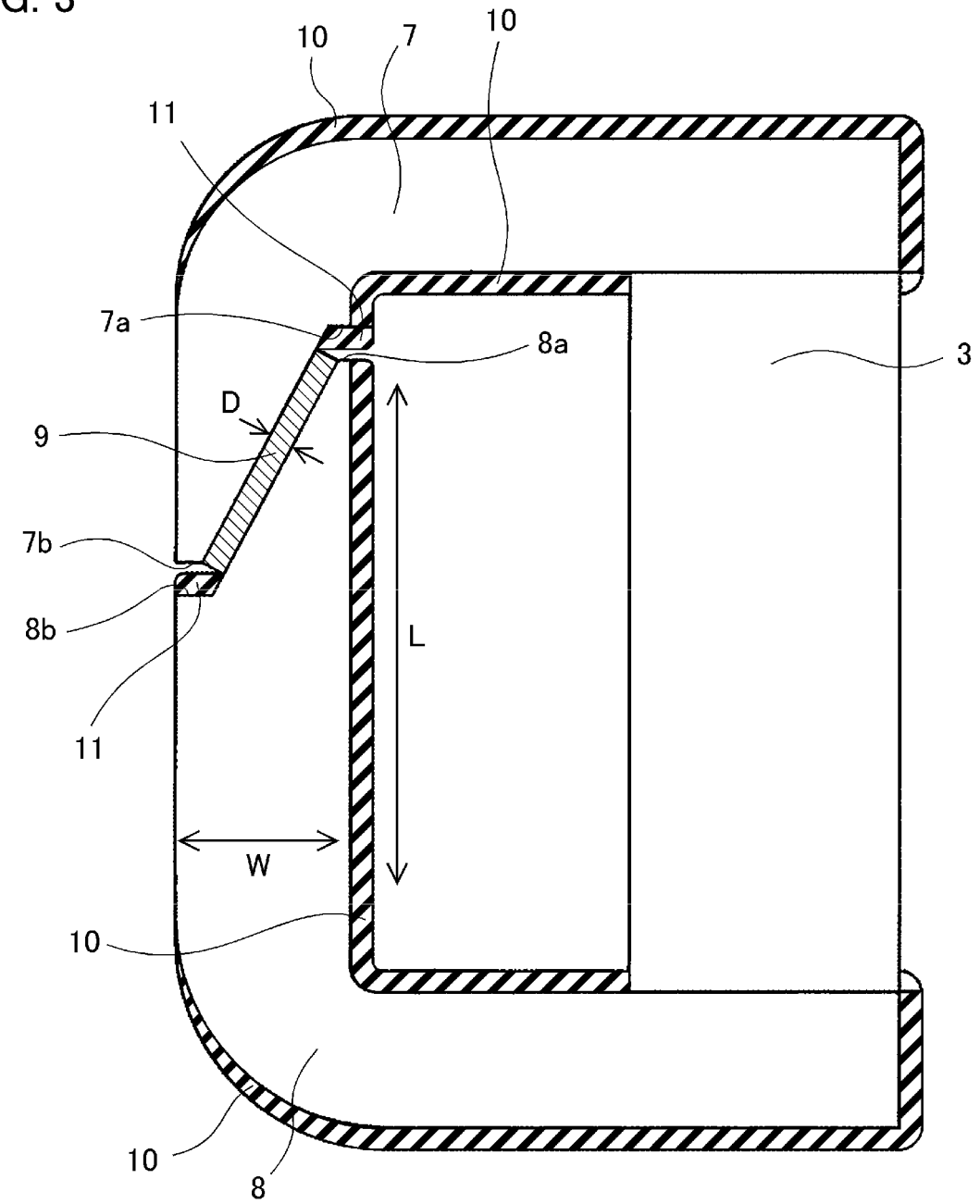
FIG. 3 is a view of a magnetic circuit portion in the ignition coil which is indicated in FIG. 2.

FIG. 3 indicates the first side iron core 7, the second side iron core 8, and the magnet 9 of the ignition coil, which are indicated in FIG. 2. At the first side iron core 7 and the second side iron core 8, separated surfaces 7*a* and 7*b* and separated surfaces 8*a* and 8*b*, which are vertical with respect to an axis direction (a "L" direction) of the side iron cores, are included at both of end portions in a width direction (a "W" direction) of the first side iron core 7 and the second side iron core 8, and a distance between the vertical separated surfaces is set in such a way that the distance is greater than a thickness "D" of the magnet 9 (for example in Embodiment 1, the distance is set at a 1.2-fold extent of the thickness "D" of the magnet 9), and intervening components 11, which are configured by using a non-magnetic material (the elastomers 10 are used in Embodiment 1), are arranged in such a way that the intervening components 11 occupy a distance which is greater than or equal to 50% (for example, 70% extent in Embodiment 1) of a distance between the separated surfaces 7*a* and 8*a* and the separated surfaces 7*b* and 8*b*, which are faced, of the first side iron core 7 and the second side iron core 8.

As described above, in the ignition coil according to Embodiment 1, facing portions, which are faced at the separated surfaces 7*a* and 7*b* and the separated surfaces 8*a* and 8*b*, which are vertical in an axis direction (a "L" direction) of the side iron cores, are provided at the first side iron core 7 and the second side iron core 8, and the intervening components 11 (a part of the elastomers 10 in Embodiment 1), which are configured by using a non-magnetic material, are arranged between the facing portions, whereby it can be inhibited that positions of the first side iron core 7 and the second side iron core 8, which compose the side iron cores, are deviated (the first side iron core 7 and the second side iron core 8 are rotated) when the first side iron core 7 and the second side iron core 8, which are formed as the side iron cores, are assembled to the center iron core 3.

Moreover, a thickness of the intervening components 11, which are configured by using a non-magnetic material, is greater than or equal to 50% of a distance between the side iron cores at the facing portions which are composed of the separated surfaces 7*a* and 7*b* of the first side iron core 7 and the separated surfaces 8*a* and 8*b* of the second side iron core 8, whereby when the first side iron core 7 and the second side iron core 8 are assembled to the center iron core 3, and when the first side iron core 7 and the second side iron core 8, which compose the side iron cores, are rotated, a distance, which is caused by a rotation of the first side iron core 7 and the second side iron core 8, between the side iron cores and the center iron core 3, is less than a distance (which is equal to a thickness of the intervening components 11) between the side iron cores, so that an adsorption force, which is acted to a gap portion which is caused among the first side iron core 7, the second side iron core 8, and the center iron core 3, is greater than an adsorption force, of the magnet holding portion, which is acted, in accordance with a magnetic force which is caused by the magnet 9, between the first side iron core 7 and the second side iron core 8.

Therefore, when an external force, which is operated when the ignition coil is assembled, is removed, the gap, which is caused among the first side iron core 7, the second side iron core 8, and the center iron core 3, is naturally closed, and the ignition coil is set at a normal assembly state. Thereby, a variation (a deviation), which is caused when the ignition coil is assembled, can be inhibited (if a gap is caused among the first side iron core 7, the second side iron core 8, and the center iron core 3 when the ignition coil is assembled, a capability of the ignition coil is lowered).

Moreover, the ignition coil has a configuration in which the intervening components 11 are not inserted to an overall portion between the vertical separated surfaces, by which the facing portions are formed, and a length of the gap can be defined by using the magnet 9, of which component accuracy is high, without using the intervening components 11 which are configured by using a non-magnetic material, of which component accuracy is low, so that a capability variation can be inhibited (when an overall portion is formed as the intervening components 11 which are configured by using a non-magnetic material, the intervening components 11 are contacted to the first side iron core 7 and the second side iron core 8 before the magnet 9 is contacted to the first side iron core 7 and the second side iron core 8 in accordance with a variation of a component, and there is a possibility in which the gap remains among the first side iron core 7, the second side iron core 8, and the magnet 9).

Moreover, a distance between the separated surfaces 7*a* and 7*b* and the separated surfaces 8*a* and 8*b*, which are vertical, is greater than a thickness of the magnet 9, whereby a magnetic force, which is generated from the magnet 9, is effectively passed through in the center iron core 3, so that the capability of the ignition coil can be improved (when a distance between the separated surfaces 7*a* and 7*b* and the separated surfaces 8*a* and 8*b*, which are vertical, is small, a magnetic flux of the magnet 9 is not passed through the center iron core 3, and is passed through space between the vertical separated surfaces, and a shortcut is performed. When a magnetic force is not passed through the center iron core 3, the capability of the ignition coil is lowered).

Moreover, the elastomers 10, which are used for performing shock absorption of an iron core stress, are used as the intervening components 11 which are configured by using a non-magnetic material, whereby the ignition coil can be configured without increasing the number of the components, and without increasing an assembly man-hour.

In addition, in the ignition coil according to Embodiment 1, although the facing portions, which are formed by using the separated surfaces 7*a* and 7*b* and the separated surfaces 8*a* and 8*b* in a state where the separated surfaces are vertical, install the intervening components 11 (a part of the elastomers 10) at only one side of the side iron cores, it is suitable that the intervening components 11 (a part of the elastomers 10) are installed at only the side iron core at the other side (at an opposite side), or are installed at both of the side iron cores. Moreover, it is suitable that the intervening components 11 are configured by using an iron core cover which covers the side iron cores.

Embodiment 2

Figure 4:
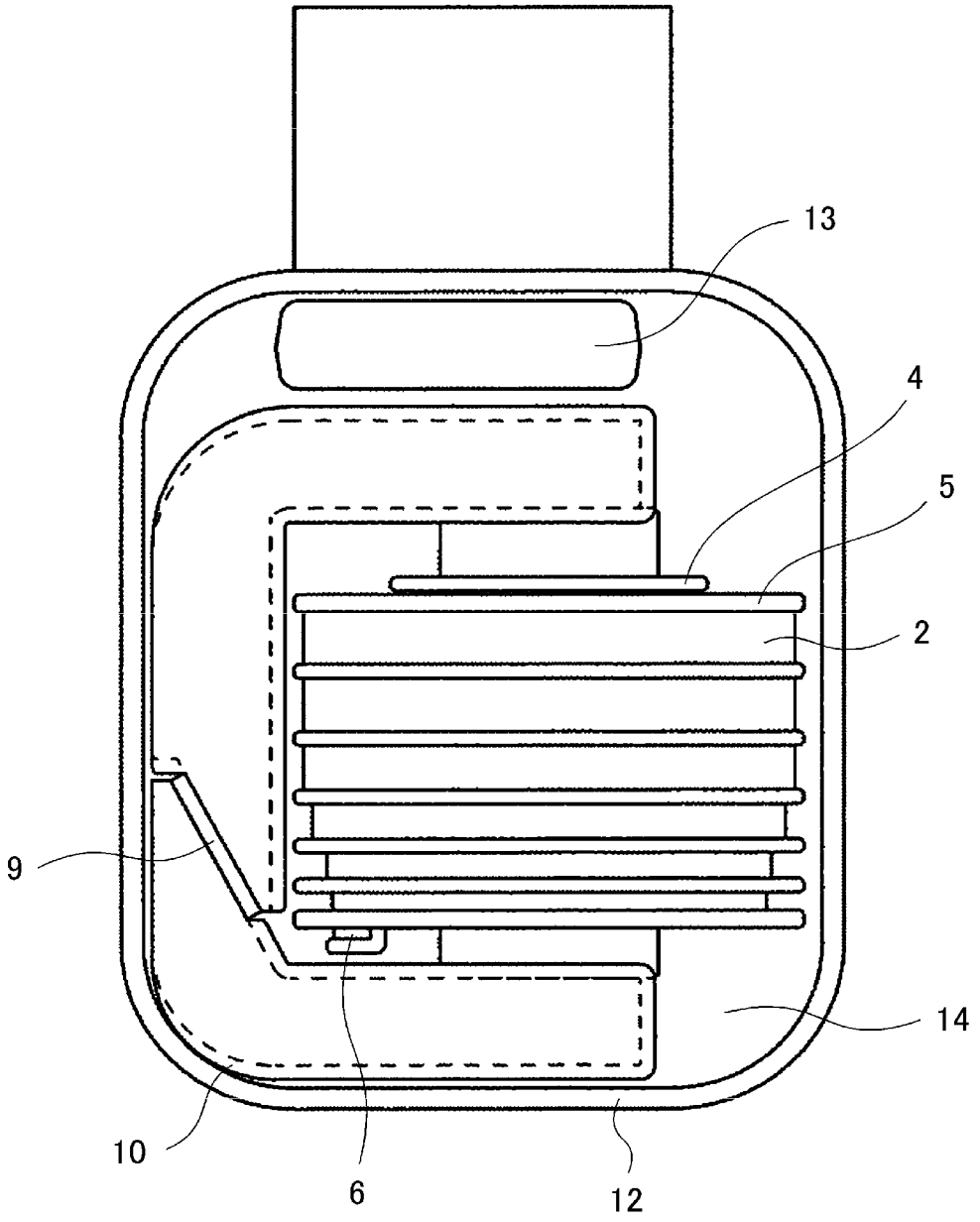
FIG. 4 is a view which indicates an ignition coil according to Embodiment 2 of the present invention.

FIG. 4 is a configuration view which indicates an ignition coil according to Embodiment 2 of the present invention. Moreover, FIG. 5 is a cross-sectional view of the ignition coil which is indicated in FIG. 4.

Figure 5:
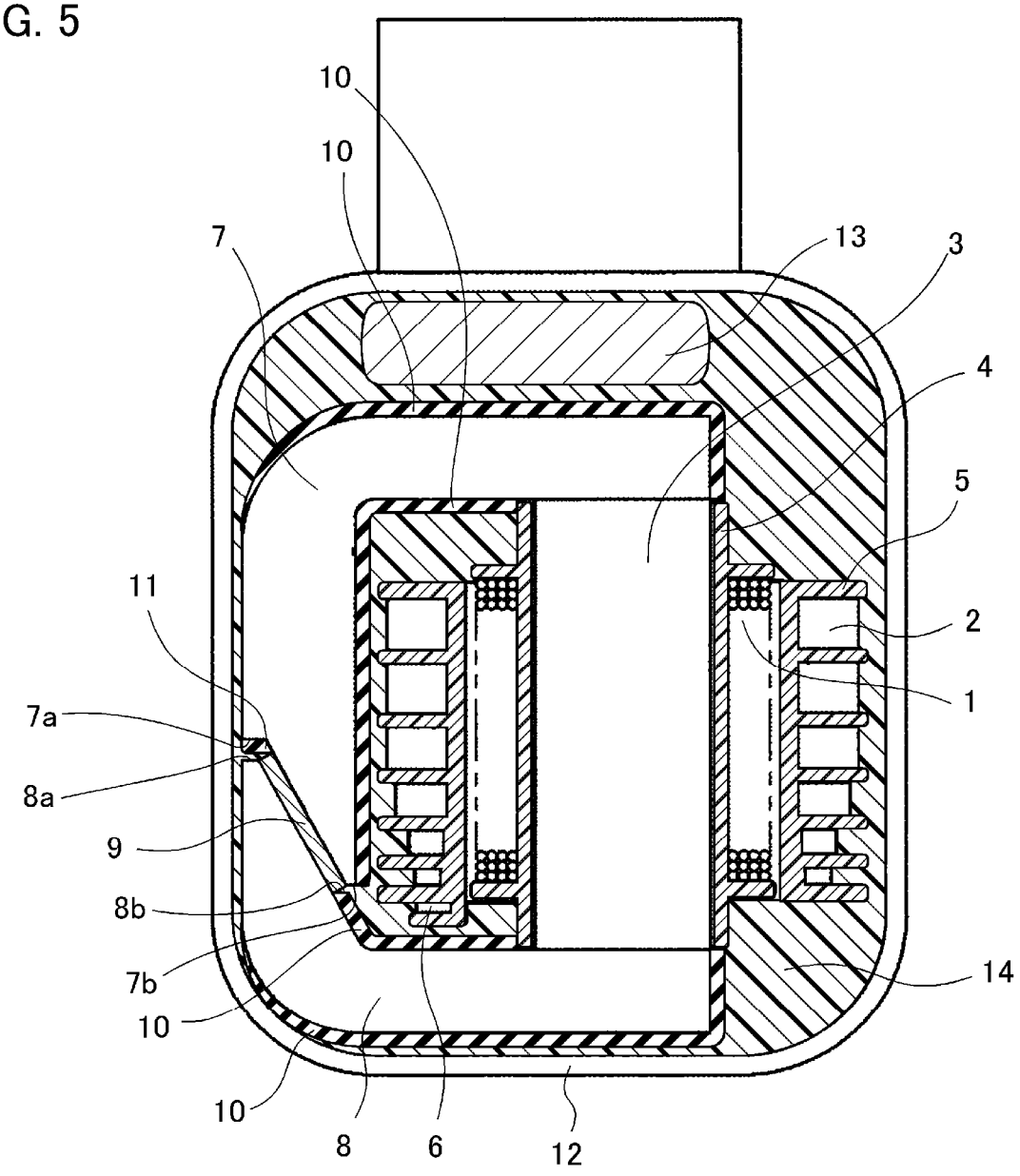
FIG. 5 is a cross-sectional view of the ignition coil which is indicated in FIG. 4.

As indicated in FIG. 4 and FIG. 5, in the ignition coil according to Embodiment 2, an insertion position of a magnet 9 is set as a high voltage side, and an intervening component 11 (a part of elastomers 10), which is configured by using a non-magnetic material, is arranged at only a case 12 side in a width direction (a "W" direction) of a first side iron core 7 and a second side iron core 8. The other configurations are similar to the configurations according to Embodiment 1.

The ignition coil according to Embodiment 2 has a configuration in which the intervening component 11 is inserted to only a high voltage side, so that an assembly variation (which is caused in accordance with a rotation of the side iron cores) can be prevented by using a similar way according to Embodiment 1.

Moreover, in the ignition coil according to Embodiment 2, the vertical separated surfaces are abolished in reference to coil sides (a primary coil 1 aide and a secondary coil 2 side) of the side iron cores (the first side iron core 7 and the second side iron core 8), and the ignition coil is configured in such a way that a abolished portion is arranged at a high voltage side (a high-voltage terminal 6 side) of the ignition coil, so that a distance between the terminal 6, which is set at a high voltage when the ignition coil is operated, and the side iron cores, at which an electric potential is low, can be secured (a distance can be secured and the ignition coil is configured by using an insulating resin 14), so that an upsizing, which is not required, of the ignition coil can be avoided, and a reliability of the ignition coil can be secured.

In the scope of the present invention, it is possible that each of the embodiments is freely combined, or each of the embodiments is suitably modified or omitted.

DESCRIPTION OF THE SYMBOLS

"1" is a primary coil; "2," a secondary coil; "3," a center iron core; "7," a first side iron core; "8," a second side iron core; "9" a magnet; "10," elastomers; "11," intervening components; "12," a case; "14," an insulating resin; "7*a*, 7*b*, 8*a*, and 8*b*," separated surfaces.

What is claimed is:

1. An ignition coil comprising:

a center iron core;

a primary coil which is wound around the center iron core;

a secondary coil which is wound around a circumference of the primary coil and is provided coaxial to the primary coil; and side iron cores which surround a part of a circumference of the secondary coil, the side iron cores comprising a first side iron core having a first separated surface at an end of a portion extending in an axis direction and a second side iron core having a second separated surface at an end of a portion extending in the axis direction, the first separated surface and the second separated surface being separated and facing each other in an oblique direction with respect to the axis direction of the side iron cores;

a magnet provided at a magnet holding portion which is formed between the first side iron core and the second side iron core which are obliquely separated, the magnet, the side iron cores, and the center iron core forming a closed magnetic passage;

first facing portions which are provided at both end portions of the first separated surface of the first side iron core and extending in a perpendicular direction with respect to the axis direction of the side iron cores and second facing portions provided at both end portions of the second separated surface of the second side iron core and extending in the perpendicular direction, each of the first facing portions facing each of the second facing portions; and intervening components, each including a non-magnetic material, the intervening components comprising:

a first intervening component provided between a first of the first facing portions and a first of the second facing portions facing each other, and a second intervening component provided between a second of the first facing portions and a second of the second facing portions facing each other, wherein a first empty space is provided between the first intervening component and the first of the second facing portions in the axis direction of the side iron cores, and a second empty space is provided between the second intervening component and the second of the first facing portions in the axis direction of the side iron cores.

2. The ignition coil as recited in claim 1, wherein the intervening components have the thickness which is greater than or equal to 50% of the distance between each of the first facing portions and each of the second facing portions facing each other.

3. The ignition coil as recited in claim 1, wherein the intervening components include an iron core cover which covers the side iron cores.

4. The ignition coil as recited in claim 2, wherein the intervening components include an iron core cover which covers the side iron cores.

5. The ignition coil as recited in claim 1, wherein the intervening components are provide at an outer side of the side iron cores.

6. The ignition coil as recited in claim 2, wherein the intervening components are provide at an outer side of the side iron cores.

7. The ignition coil as recited in claim 3, wherein the intervening components are provide at an outer side of the side iron cores.

8. The ignition coil as recited in claim 4, wherein the intervening components are provide at an outer side of the side iron cores.

9. The ignition coil as recited in claim 1, wherein the distance between each of the first facing portions and each of the second facing portions facing each other is greater than a thickness of the magnet.

10. The ignition coil as recited in claim 2, wherein the distance between each of the first facing portions and each of the second facing portions facing each other is greater than a thickness of the magnet.

11. The ignition coil as recited in claim 3, wherein the distance between each of the first facing portions and each of the second facing portions facing each other is greater than a thickness of the magnet.

12. The ignition coil as recited in claim 4, wherein the distance between each of the first facing portions and each of the second facing portions facing each other is greater than a thickness of the magnet.

13. The ignition coil as recited in claim 5, wherein the distance between each of the first facing portions and each of the second facing portions facing each other is greater than a thickness of the magnet.

14. The ignition coil as recited in claim 6, wherein the distance between each of the first facing portions and each of the second facing portions facing each other is greater than a thickness of the magnet.

15. The ignition coil as recited in claim 7, wherein the distance between each of the first facing portions and each of the second facing portions facing each other is greater than a thickness of the magnet.

16. The ignition coil as recited in claim 8, wherein the distance between each of the first facing portions and each of the second facing portions facing each other is greater than a thickness of the magnet.

* * * * *